US008336134B2

(12) United States Patent
Jelinek

(10) Patent No.: US 8,336,134 B2
(45) Date of Patent: Dec. 25, 2012

(54) BED WITH MOBILE LIFT DOCKING

(75) Inventor: Jeffrey S. Jelinek, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 50 days.

(21) Appl. No.: 13/020,202

(22) Filed: Feb. 3, 2011

(65) Prior Publication Data

US 2012/0198613 A1 Aug. 9, 2012

(51) Int. Cl.
*A61G 7/10* (2006.01)

(52) U.S. Cl. ..... 5/83.1; 5/87.1; 5/84.1

(58) Field of Classification Search ..... 5/600, 81.1 R, 5/83.1, 84.1, 86.1, 87.1, 89.1, 503.1, 510, 5/658, 662
See application file for complete search history.

(56) References Cited

U.S. PATENT DOCUMENTS

| | | | | |
|---|---|---|---|---|
| 4,592,104 | A | 6/1986 | Foster et al. | |
| 5,005,233 | A * | 4/1991 | Toivio et al. | 5/83.1 |
| 5,117,521 | A | 6/1992 | Foster et al. | |
| 5,335,384 | A | 8/1994 | Foster et al. | |
| 5,335,651 | A | 8/1994 | Foster et al. | |
| 5,337,845 | A | 8/1994 | Foster et al. | |
| 5,370,111 | A | 12/1994 | Reeder et al. | |
| 5,406,658 | A * | 4/1995 | Olkkonen et al. | 5/83.1 |
| 5,454,126 | A | 10/1995 | Foster et al. | |
| 5,457,831 | A | 10/1995 | Foster et al. | |
| 5,479,666 | A | 1/1996 | Foster et al. | |
| 5,497,766 | A | 3/1996 | Foster et al. | |
| 5,513,406 | A | 5/1996 | Foster et al. | |
| 5,577,279 | A | 11/1996 | Foster et al. | |
| 5,708,997 | A | 1/1998 | Foster et al. | |
| 6,112,345 | A * | 9/2000 | Foster et al. | 5/81.1 R |
| 6,175,973 | B1 | 1/2001 | Hakamiun et al. | |
| 6,289,534 | B1 | 9/2001 | Hakamiun et al. | |
| 6,360,389 | B1 * | 3/2002 | Gallant et al. | 5/658 |
| 6,725,474 | B2 | 4/2004 | Foster et al. | |
| 7,434,278 | B2 * | 10/2008 | White et al. | 5/81.1 R |
| 7,604,219 | B2 | 10/2009 | Liljedahl | |
| 7,644,458 | B2 * | 1/2010 | Foster et al. | 5/510 |
| 2010/0224841 | A1 | 9/2010 | Liljedahl | |

FOREIGN PATENT DOCUMENTS

WO WO 2009/055635 A1 4/2009

OTHER PUBLICATIONS

Liko: Sabina II Instruction Guide, dated Jul. 7, 2009 (8 pages).
Liko: Sabina II EE, dated Oct. 2008 (2 pages).
Liko: Lifting Solutions, dated Jul. 2009 (22 pages).
Liko: Sabina II Quick Reference Guide, undated (1 page).

* cited by examiner

*Primary Examiner* — Michael Trettel
(74) *Attorney, Agent, or Firm* — Barnes & Thornburg LLP

(57) ABSTRACT

A patient support may, among other things, support a person in a laying-down or a seated position. A mobile lift may assist a person with the process of moving from a seated or laying-down position to a standing position, or moving from one type of patient support to another (e.g. from a bed to a wheelchair or vice versa). A docking apparatus may secure the position of the mobile lift relative to the patient support. The docking apparatus may include an electrical connection between the mobile lift and the patient support. The docking apparatus may permit control of the mobile lift by the patient support, and/or permit control of the patient support by the mobile lift.

19 Claims, 8 Drawing Sheets

BED WITH MOBILE LIFT DOCKING

BACKGROUND

This disclosure relates generally to patient supports that are capable of supporting a person in one or more positions, including a horizontal position. Such patient supports include beds, stretchers, and other similar devices. More particularly, this disclosure relates to patient supports that are used to support persons who need assistance with their mobility, for example, patients who require assistance with ingress to or egress from a patient support.

Patient supports of this type may be found, for example, in healthcare facilities, homes, and other locations in which care is provided. Examples include the TotalCare®, VersaCare®, CareAssist®, and Advanta™ 2 beds, which are available from the Hill-Rom Company, Inc.

Mobile lifts are devices that are designed to assist persons with their mobility. For example, some mobile lifts are designed to support a person during the person's movement from a seated position to a standing position. Generally, mobile lifts have a wheeled base that allows them to be located next to a patient support. Some common situations where mobile lifts are employed include transfers of a person from a bed, chair, or wheelchair to a toilet; from a bed, chair, or wheelchair to a walker; from a bed to a chair, wheelchair, or other type of support; and from the floor to a bed, chair, wheelchair, or other type of support.

Some examples of mobile lifts are described in U.S. Pat. Nos. 6,175,973 and 6,289,534. Other examples include the Sabina II, the Viking series, the Golvo series, and other models, which are available from Liko, a Hill-Rom Company.

SUMMARY

The present invention comprises one or more of the features recited in the appended claims and/or the following features which, alone or in any combination, may comprise patentable subject matter.

According to one aspect of this disclosure, a patient support includes a base, which is supported by a plurality of wheels. The base has a downwardly facing under side and an upwardly facing top side opposite the under side. The patient support also includes a frame supported above the base. The frame has a head end and a food end spaced from the head end. The patient support also includes a deck supported by the frame, where the deck may support a person in a plurality of positions including a laying-down position and a sitting position. The patient support also includes a docking apparatus, which is spaced from the head end of the frame, coupled to the base, and located substantially beneath the top side of the base. The docking apparatus may engage at least one leg of a mobile lift, where the mobile lift including a lift arm configured to assist a person in moving from one location to another, and the leg of the mobile lift is supported by a wheel. The docking apparatus may secure the position of the mobile lift relative to the patient support while a person is being transferred from the patient support to the mobile lift or from the mobile lift to the patient support.

The docking apparatus may include a guide mounted to the under side of the base. The guide may guide a leg of the mobile lift to a docking position underneath the base, in which the leg may be secured relative to the patient support. The guide may include a pair of guide members, which may be spaced apart by a distance, which is defined to receive the leg of the mobile lift therein. The patient support may include an actuator coupled to the guide to adjust the distance between the guide members.

The patient support may include a second guide coupled to the base and spaced from the first guide. The second guide may include a pair of guide members that may guide a second leg of the mobile lift to a docking position underneath the base. The guide members may extend downwardly from the under side of the base.

The docking apparatus may include an electrical connector, which is configured to mate with an electrical connector of the mobile lift to establish an electrical communication link between the patient support and the mobile lift.

The docking apparatus may include a sensor, which is configured to detect the presence of a leg of a mobile lift in the docking position.

The docking apparatus may be mounted to the base adjacent the foot end of the frame and may engage a portion of a leg of the mobile lift when the mobile lift is positioned adjacent the foot end of the frame. The docking apparatus may be mounted to the base between the head end and the foot end of the frame and may engage a portion of a leg of the mobile lift when the leg of the mobile lift is positioned between the head end and the foot end of the frame. The docking apparatus may engage a portion of the leg of the mobile lift when the portion of the leg is positioned underneath the base.

According to another aspect of this disclosure, a lift-to-bed docking apparatus includes a lift guide. The lift guide includes a top surface couplable to an under side of a support member of a bed and at least one downwardly extending surface configured to guide a leg of a mobile lift to a docking position underneath the bed. The lift-to-bed docking apparatus also includes a bed-to-lift connector coupled to the lift guide, and a lift-to-bed connector couplable to a mobile lift. The mobile lift has a lift arm configured to assist a person in moving from one location to another. The lift-to-bed connector connects with the bed-to-lift connector to secure the mobile lift in the docking position while a person is being transferred from the bed to the mobile lift or from the mobile lift to the bed.

The lift guide may include one or more downwardly extending guide members. One or more of the bed-to-lift connector and the lift-to-bed connector may include a retaining mechanism configured to releasably connect the leg of the mobile lift with the bed. One or more of the bed-to-lift connector and the lift-to-bed connector may include an electrical connector configured to mate with the other to establish an electrical communication link between the patient support and the mobile lift. One or more of the bed-to-lift connector and the lift-to-bed connector may include a sensor configured to detect a position of the leg relative to the bed.

According to a further aspect of this disclosure, a control system for a bed executes routines configured to determine whether a mobile lift is connected to the bed, where the mobile lift includes a lift arm configured to assist a person in moving from one location to another, receive input from a user control of the bed, where the user control controls a feature of the mobile lift, if the mobile lift is connected to the bed, and communicate with the mobile lift to cause the feature of the mobile lift to be controlled in accordance with the user control of the bed.

The control system may include a routine to receive a signal from the mobile lift, where the signal is configured to control a feature of the bed, and cause the feature of the bed to be controlled by the signal from the mobile lift. The signal from the mobile lift may control the raising and/or lowering of a portion of the bed. The user control of the bed may control the raising and lowering of the lift arm of the mobile lift.

BRIEF DESCRIPTION OF THE DRAWINGS

The detailed description particularly refers to the following figures, in which.

DETAILED DESCRIPTION

Figure 1:
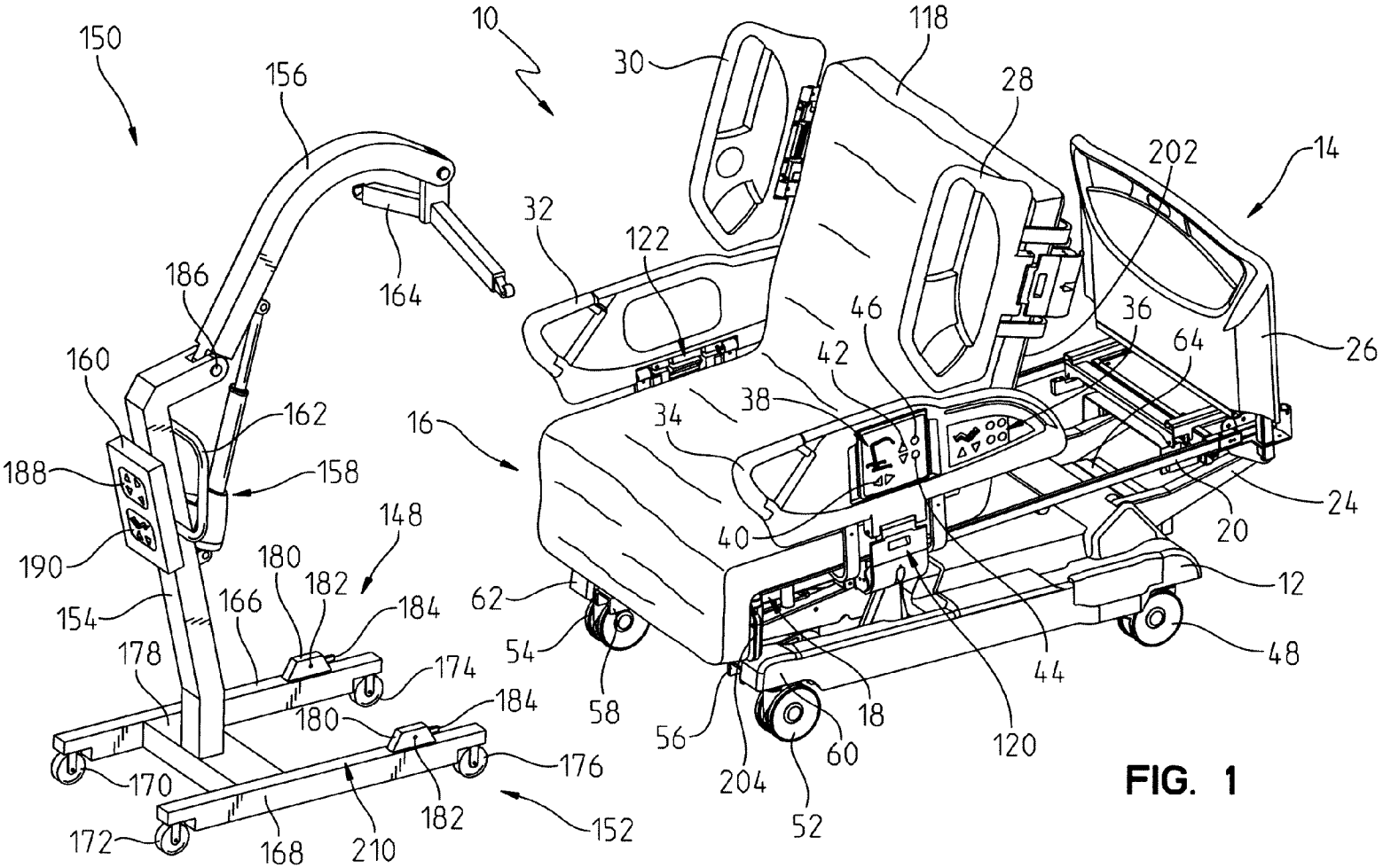
FIG. 1 is a perspective view of a bed that includes a mobile lift docking apparatus mounted to the foot end of the bed, and a mobile lift that includes a pair of lift-to-bed connectors, where the mobile lift includes buttons that are configured to control one or more features of the bed, and the bed includes buttons that are configured to control one or more features of the mobile lift.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Figure 6:
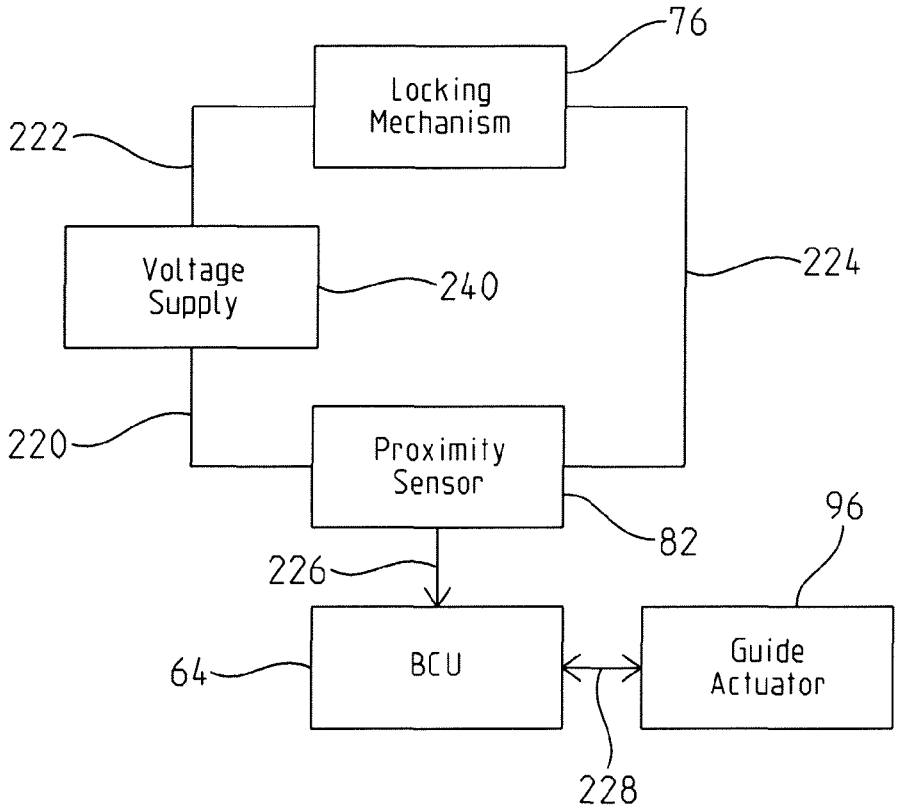
FIG. 6 is a block diagram of control circuitry that is designed to control a locking mechanism and a guide actuator of the mobile lift docking apparatus of FIGS. 3-4.
Figure 7:
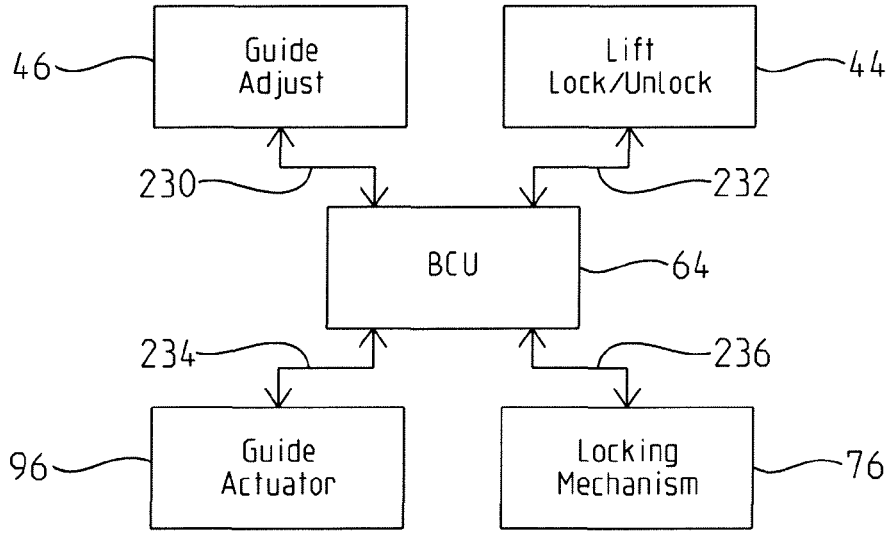
FIG. 7 is a block diagram of another version of control circuitry that is designed to control a locking mechanism and a guide actuator of the mobile lift docking apparatus of FIGS. 3-4.
Figure 8:
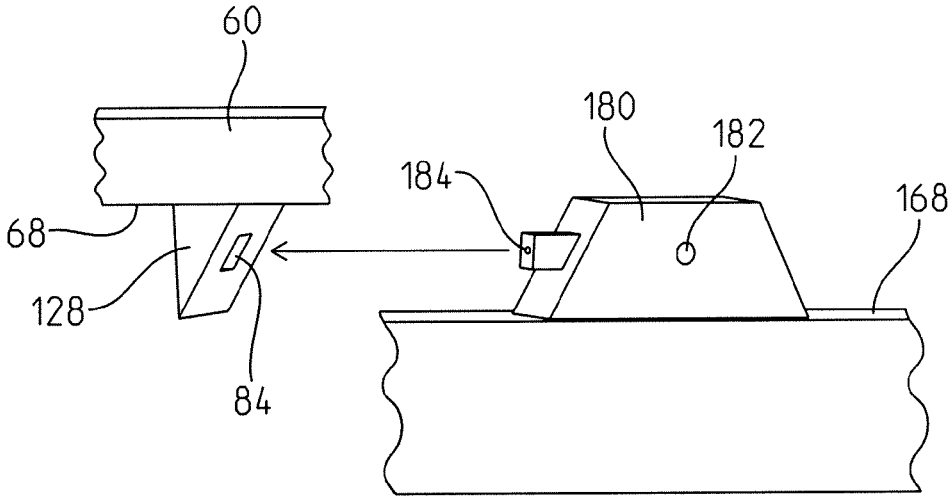
FIG. 8 is a partial perspective view of an electrical bed-to-lift connector mounted to a bed, and a corresponding electrical lift-to-bed connector mounted to a leg of a mobile lift.
Figure 9:
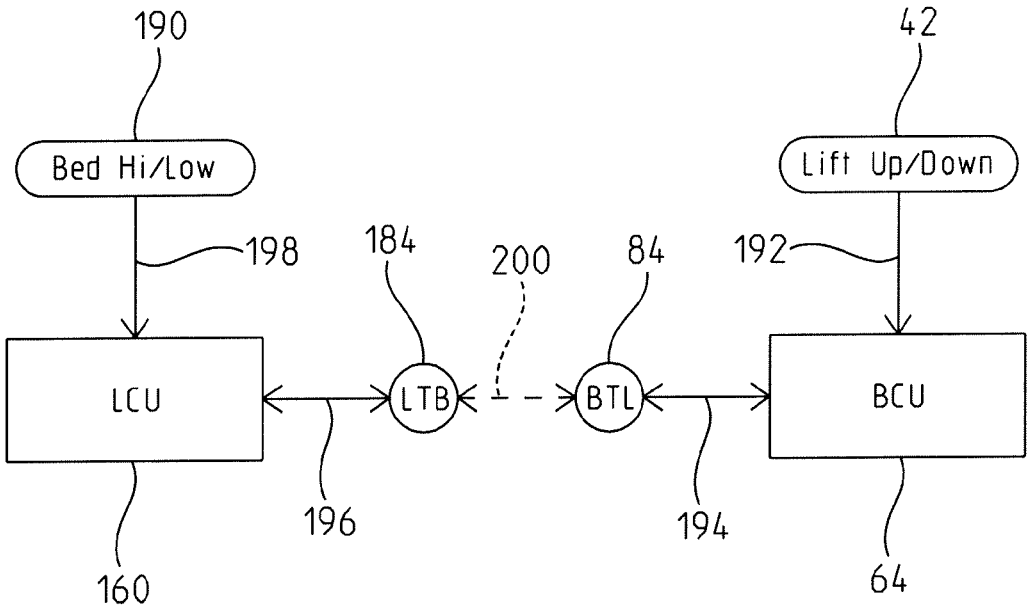
FIG. 9 is a block diagram illustrating an electronic communication link between a bed and a mobile lift.
Figure 10:
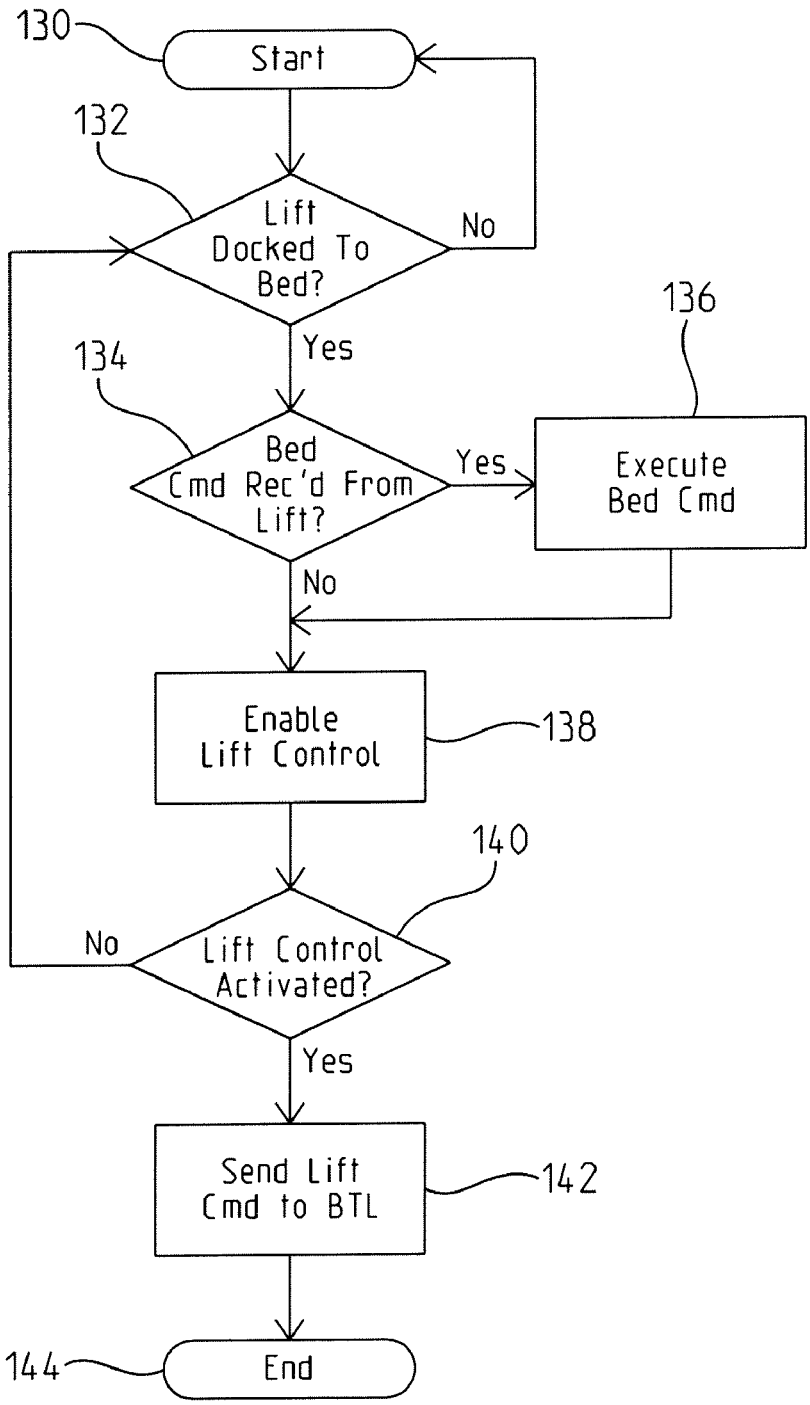
FIG. 10 is a flow diagram illustrating processes that are executable by a bed to control features of a mobile lift and to receive bed commands from the mobile lift.

A bed 10 is shown in FIG. 1. The bed 10 is designed to support a person in a seated or a laying-down position. Some persons may not be able to enter or leave the bed 10 without assistance. A mobile lift 150 may be positioned adjacent the bed 10 to provide such assistance. In accordance with this disclosure, the bed 10 includes a foot-end docking apparatus 56, 58 (FIGS. 1-2), and/or one or more of a side docking apparatus 90 (FIGS. 3-5); and the lift 150 includes one or more of a mating connector 148. The docking apparatus 56, 58, 90 receives the mating connector 148 to establish a secure mechanical linkage between the lift 150 and the bed 10. Some features of the docking apparatus 58, 60, 90 may be electronically controlled (FIGS. 6-7). The connection between the mobile lift 150 and the bed 10 may include a mechanical connection without an electrical connection, or may include one-way electronic communication (i.e. the bed 10 sends electrical signals to the lift 150 or vice versa), or may include a two-way electronic communication link (i.e. the bed 10 and the lift 150 each send electrical signals to each other) (FIGS. 8-10).

The bed 10 is of a type that is typically used in hospitals and other facilities in which health care is provided. More specifically, the bed 10 is of a type that can support a person in a variety of positions, including a laying-down position and a seated position, and includes a number of features that are controlled electronically by an on-board bed control unit (BCU) 64. However, this disclosure applies to any type of bed or similar structure, including but not limited to stretchers and other patient support structures, whether or not all of the features of the illustrated bed 10 are included in such structure, and whether or not such patient support structure includes other features not mentioned herein.

While the bed 10 often assumes a flat or horizontal position, which can support a person who is laying down, FIG. 1 shows the bed 10 in a chair position, which can support a person who is sitting up. The bed 10 has a head end 14 and a foot end 16 longitudinally spaced from the head end 14. Although shown in FIG. 1 as such, the foot end 16 is not required to be at an angle of ninety degrees from horizontal or nearly so, in order to achieve a chair position. A chair position may be achieved when the foot end 16 is at an angle of less then ninety degrees. For example, in some beds, the chair position is achieved when the angle of the foot end 16 is at about 70 percent of vertical. However the bed 10 is configured, a person may exit the bed 10 at the foot end 16 when the bed 10 is in the chair position.

The bed 10 includes a base 12. The base 12 includes a pair of longitudinally-extending side members 60, 62, which are laterally spaced from each other by a cross member 66. The base 12 is movably supported by a pair of head end casters 48, 50 and a pair of foot end casters 52, 54. The casters 48, 50, 52, 54 each include one or more wheels that movably support the bed 10 relative to a floor or other surface, in one or more directions.

A frame 20 is coupled to and supported by the base 12. A lift mechanism, which includes a pair of foot end lift arms 22 and a pair of head end lift arms 24, is coupled to the base 12 and to the frame 20. The lift arms 22, 24 operate to raise, lower, and tilt the frame 20 relative to the base 12. Movement of the lift arms 22, 24 is driven by a pair of actuators 86, 88.

A deck 18 is coupled to and supported by the frame 20. The deck 18 supports a mattress 118, which, in turn, may support a person positioned thereon. The deck 18 has a number of sections including, in the illustrated embodiment, an articulating head section 202 and an articulating foot section 204, which, as noted above, allow the bed 10 to assume a variety of positions including a horizontal position, a chair position, and a number of positions intermediate the horizontal and chair positions.

The bed 10 has a number of siderails, namely opposing head end siderails 28, 30 and opposing foot end siderails 30, 32. At least the foot end siderails 30, 32 have a latching mechanism 120, 122 that allows them to be lowered below the height of the top of the mattress 118. When a foot end siderail 30, 32 is lowered, a person may exit the bed 10 from the side rather than from the foot end 16 of the bed 10. The bed 10 also has a head endboard 26. Although not shown, a foot endboard may also be provided.

The lift 150 has a base 152, which includes a pair of longitudinally-extending legs 166, 168. The lift legs 166, 168 are spaced from each other by a cross member 178. The base 152 is movably supported by a pair of rear casters 170, 172 and a pair of front casters 174, 176. In the illustrated embodiment, each of the lift legs 166, 168 has mounted thereto or integrated therewith a mating connector 148, described further below. In other embodiments, only one of the legs 166, 168 may be equipped with a mating connector 148.

The base 152 supports a column 154. A lift arm 156 is pivotably coupled to the column 154 by a pivot 186. A lift actuator 158 operates to pivot the lift arm 156 at the pivot 186, to thereby raise and lower the lift arm 156 relative to the base 152 and the column 154. A handle 162 may be attached to the column 154. The handle 162 may be used by a caregiver or other staff person to transport the mobile lift 150 from one location to another (e.g., from a position away from the bed 10 to a docking position adjacent the bed 10).

Generally, an attachment bar 164 or other suitable structure is attached to the lift arm 156. In operation, one end of each of a pair of lift straps (not shown) is coupled to opposite ends of the attachment bar 164. The other end of each of the lift straps is connected to a sling, vest, or similar device, which is placed underneath or around a patient, so that when the lift arm 156 raises or lowers, the patient is correspondingly lifted up from a patient support or other point of origin, or lowered toward a patient support or other destination.

The lift 150 includes a lift control unit (LCU) 160. The LCU 160 includes electrical and/or computer circuitry that is connected to the lift actuator 158 to control the raising and lowering of the lift arm 156. One or more lift control buttons 188 are electronically coupled to the LCU 160 to enable a caregiver to raise or lower the lift arm 156 by touching one of the buttons 188.

In some embodiments, the lift 150 may include a leg adjustment actuator (not shown), which may be used to adjust the distance between the lift legs 166, 168 as needed for a given application of the lift 150. For example, the distance between the lift legs 166, 168 may need to be increased or decreased in order for the mating connectors 148 to align with the docking apparatus 56, 58. In these embodiments, the lift control buttons 188 may include one or more buttons that are electronically coupled to the LCU 160 to enable a caregiver to increase or decrease the distance between the lift legs 166, 168 (e.g. make the distance wider or narrower) by touching the button or buttons.

Figure 2:
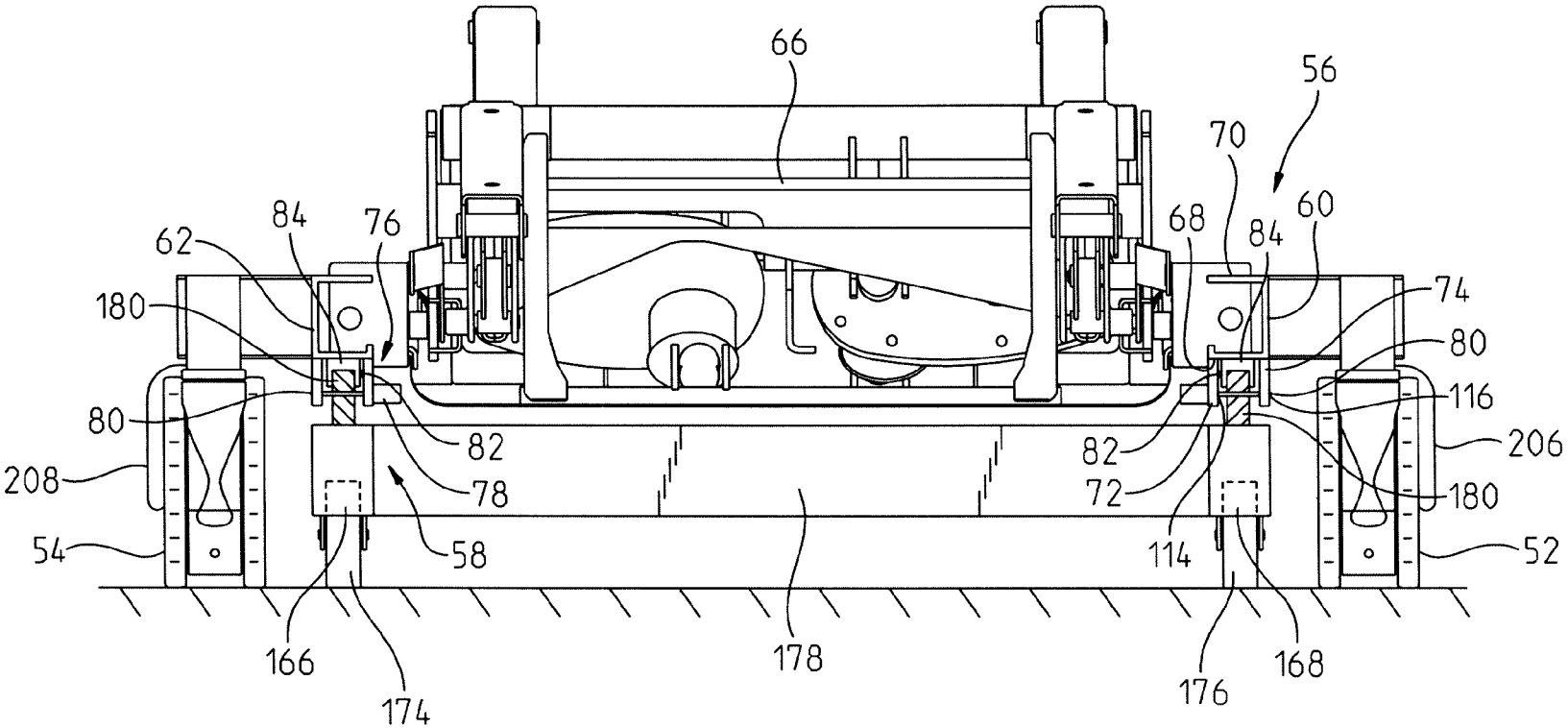
FIG. 2 is a partial end view of the mobile lift docking apparatus of FIG. 1, with a partially sectional view of a mobile lift docked thereto, from the vantage point of a person standing at the foot end of the bed.

As shown in FIG. 2, the docking apparatus 56, 58 enables the lift 150 to securely mechanically connect with the bed 10, via the mating connectors 148. The docking apparatus 58 includes the same components as the docking apparatus 56, therefore, only the docking apparatus 56 is described, and the same reference numbers are used to denote the components of the docking apparatus 58 as are used to denote the components of the docking apparatus 56. Likewise, each of the lift mating connectors 148 contains the same components and thus, only one of the lift mating connectors 148 is described, and the same reference numbers are used to refer to the components of each of the lift mating connectors 148.

In the illustrated embodiment, all components of the docking apparatus 56, 58 are located between the casters 52, 54, underneath the base 12 (i.e. within a footprint of the bed 10). In other embodiments, however, all or portions of the docking apparatus 56, 58 may be located above or outside the casters 52, 54, above or to the side of the base 12, or outside a footprint of the bed 10. For example, the docking apparatus 56 may be attached to an outer surface 206 of the caster 52 while the docking apparatus 58 may be attached to an outer surface 208 of the caster 54.

The base member 60 has an under side 68, which faces downwardly toward the floor or other surface on which the bed 10 is supported. The base member 60 also has a top side 70, which is spaced from the under side 68 and faces upwardly toward the frame 20.

The docking apparatus 56 includes a pair of guide members 72, 74, each of which is mounted to or integral with (e.g. via bolts, welding, or other fastening means) the under side 68 of the base member 60. The guide members 72, 74 are substantially parallel to each other and substantially perpendicular to the cross member 66. The guide members 72, 74 are laterally spaced from each other by a distance that is sufficient to allow one of the lift legs 166, 168 of the lift 150 to travel in and out thereof. The guide members 72, 74 extend downwardly from the under side 68 of the base toward the floor or other surface on which the bed 10 is supported.

Each of the guide members 72, 74 has a hole 114, 116, respectively, defined therein. The holes 114, 116 are vertically aligned with each other and sized so that a locking member (e.g. a pin) 80 may be inserted therethrough. The locking member 80 is part of a bed-to-lift locking mechanism 76, which secures the position of a lift leg 166, 168 relative to the bed 10 when the lift leg 166, 168 is located between the guide members 72, 74.

The bed-to-lift locking mechanism 76 also includes a lock actuator 78, which is mounted to or integral with (e.g. via bolts, welding, or other fastening means) one of the guide members (shown here as mounted to the guide member 72). The lock actuator 78 is a spring, solenoid, or other similar device that enables the locking member 80 to move between a locked position and an unlocked position. In the locked position, the locking member 80 securely connects the lift leg 166, 168 to the guide members 72, 74. FIG. 2 shows the locking member 80 in the locked position. In the unlocked position, the locking member 80 allows the lift leg 166, 168 to move relative to the guide members 72, 74 (e.g., the locking member 80 retracts to a position located to the outside of the guide member 72).

The lift mating connector 148 includes a docking tab 180. The docking tab 180 is mounted to or integral with (e.g. via bolts, welding, or other fastening means) a top surface 210 of the lift leg 166, 168. The docking tab 180 extends upwardly away from the top surface 210, and is sized to fit within the space defined by the guide members 72, 74 of the docking apparatus 56. The docking tab 180 has a hole 182 therethrough. The hole 182 is sized to correspond with the size of the holes 114, 116 of the guide members 72, 74. Also, the hole 182 is located on the docking tab 180 so that when the lift leg 166, 168 is positioned within the guide members 72, 74, the hole 182 is vertically aligned with the holes 114, 116 of the guide members 72, 74. Thus, the locking member 80 extends through each of the holes 114, 182, 116, when the locking member 80 is in the locked position. When the locking member 80 is in the unlocked position, the locking member 80 is not located in the holes 116, 182, although it may still be located in the hole 114, so long as the lift leg 166, 168 is permitted to move freely relative to the bed 10.

In embodiments where the lock actuator 78 is a spring, the locking member 80 may be held in the unlocked position (with the spring compressed) by a detent or friction lock, which is coupled to the guide member 72. Movement of the lift leg 166, 168 to the docking position applies a force to the detent or friction lock, which releases the spring, causing the locking member 80 to move to the locked position. To undock the lift leg 166, 168, a force is applied in the opposite direction.

Although not required, the docking apparatus 56 includes a proximity sensor 82. The proximity sensor 82 is mounted (e.g. to an inner side of the guide member 72, although this is not required. The proximity sensor 82 may be mounted to the under side 68 of the base member 60, to the guide member 74, or to any other structure of the bed 10 or the docking apparatus 56, 58, as long as it is able to detect the presence of a lift leg 166, 168 between the guide members 72, 74.

The proximity sensor 82 is of a conventional type (such as an inductive, capacitive, infrared, magnetic, or optical sensor), or of a type developed after the date of this disclosure. The proximity sensor 82 is configured to detect the presence of a lift leg 166, 168 at a docking position (e.g. between the guide members 72, 74). The proximity sensor 82 is coupled to the bed-to-lift locking mechanism 76 via electrical circuitry (FIG. 6, described below), such that when the proximity sensor 82 detects entry of a lift leg 166, 168 into the docking position, an electrical signal is transmitted to the bed-to-lift locking mechanism 76, to cause the lock actuator 78 to move the locking member 80 in a horizontal direction to the locking position. For example, where the lock actuator 78 includes a solenoid, the electrical output from the proximity sensor 82 may be used to energize the solenoid.

Although not required, the docking apparatus 56 also includes a bed-to-lift electrical connector 84. The bed-to-lift electrical connector 84 is supported by a housing 128 that is mounted to the under side 68 of the base member 60 (e.g. by bolts, brackets, welding, or the like) so that the bed-to-lift electrical connector 84 is positioned to the rear of the docking mechanism 56, extending downwardly between the guide members 72, 74. When a lift leg 166, 168 is in the docking position, the bed-to-lift electrical connector 84 mates with a lift-to-bed electrical connector 184, if one is installed on the lift 150 (e.g. on the lift mating connector 148).

The bed-to-lift electrical connector 84 includes a wired or wireless communications link, such as an Ethernet connector (e.g. an RJ-45 or 802.3 connector), which may be of the male or female type. The bed-to-lift electrical connector 84 is electronically coupled to the BCU 64 by suitable cabling (e.g. insulated wiring) that is routed through the base member 60 to an electrical port (not shown) located on the BCU 64 (e.g. an RS-232, USB, parallel, serial, or other suitable type of electrical port). As described further below, the bed-to-lift electrical connector 84 communicates electrical signals from the BCU 64 to the lift 150, and/or to communicate electrical signals received from the lift 150 to the BCU 64, when the lift 150 is docked to the bed 10.

If the docking apparatus 56 includes a bed-to-lift electrical connector 84, the lift 150 may include a corresponding lift-to-bed electrical connector 184. In the illustrated embodiment, the lift-to-bed electrical connector 184 is mounted to the mating connector 148, however, this need not be the case. In other embodiments, the lift-to-bed electrical connector 184 may be provided on the cross member 178 or other structural component of the lift 150. In embodiments where the lift-to-bed electrical connector 184 is not mounted to a lift leg 166, 168, the corresponding bed-to-lift-connector 84 may, of course, be located elsewhere on the bed 10 as well. For instance, the bed-to-lift electrical connector 84 may be mounted to the cross member 66 to align with a lift-to-bed electrical connector 184 mounted to the cross member 178 of the lift 150.

The lift-to-bed electrical connector 184 includes a wired or wireless communications link, such as an Ethernet connector (e.g. an RJ-45 or 802.3 connector), which may be of the male or female type, to mate with the bed-to-lift electrical connector 84.

The lift-to-bed electrical connector 184 is electronically coupled to the LCU 160 by suitable cabling (e.g. insulated wiring) that is routed through the lift leg 166, 168 and the column 154 to an electrical port (not shown) located on the LCU 160 (e.g. an RS-232, USB, parallel, serial, or other suitable type of port). As described further below, the lift-to-bed electrical connector 184 is configured to communicate electrical signals from the LCU 160 to the bed 10, and/or to communicate electrical signals received from the bed 10 to the LCU 160, when the lift 150 is docked to the bed 10.

Figure 3:
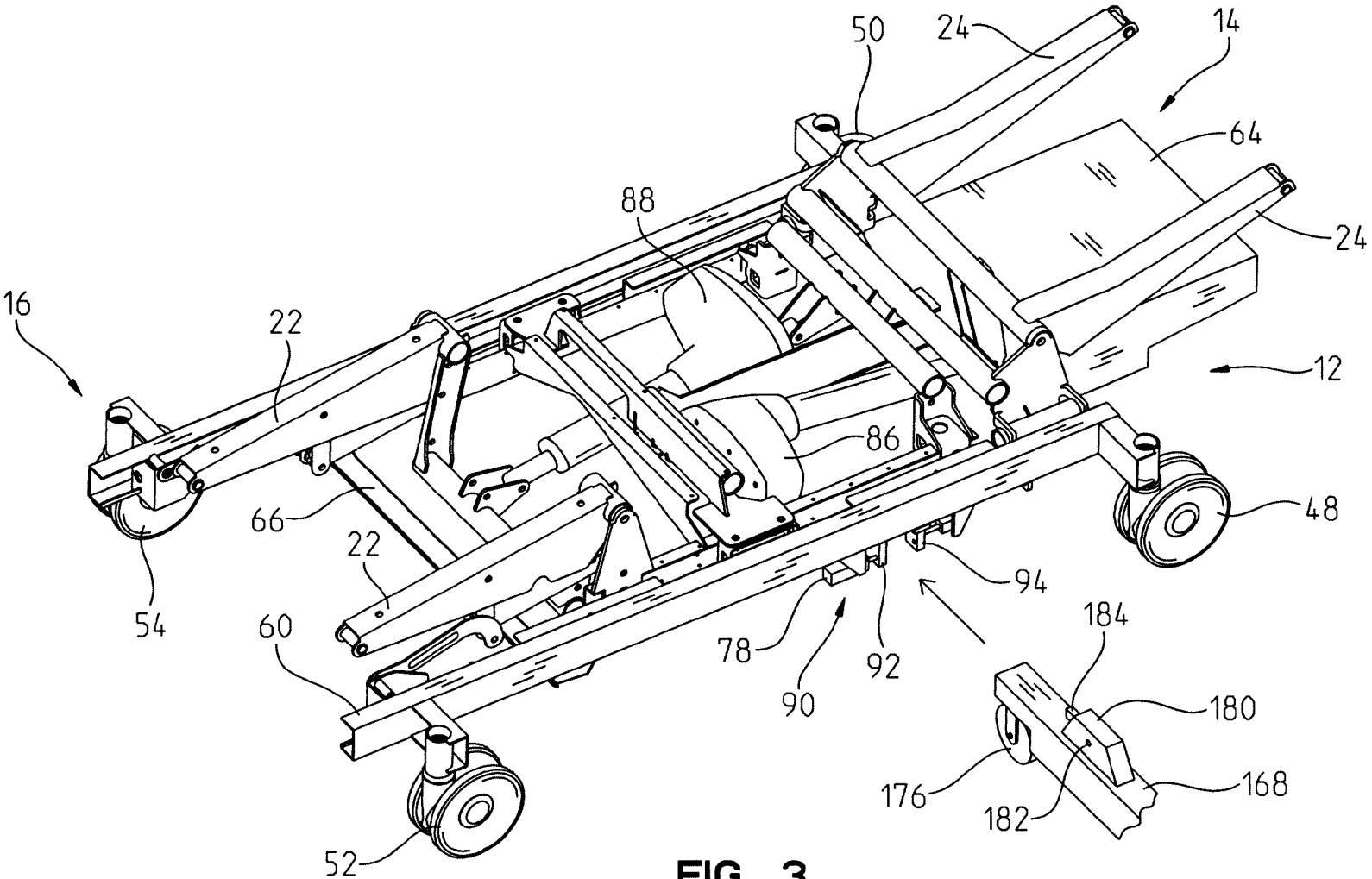
FIG. 3 is a perspective view of the base of the bed of FIG. 1, including another version of a mobile lift docking apparatus, which is mounted to one of the longitudinal sides of the base, and showing a partial view of a leg of a mobile lift, where the leg includes a lift-to-bed connector that is designed to connect with the mobile lift docking apparatus.
Figure 4:
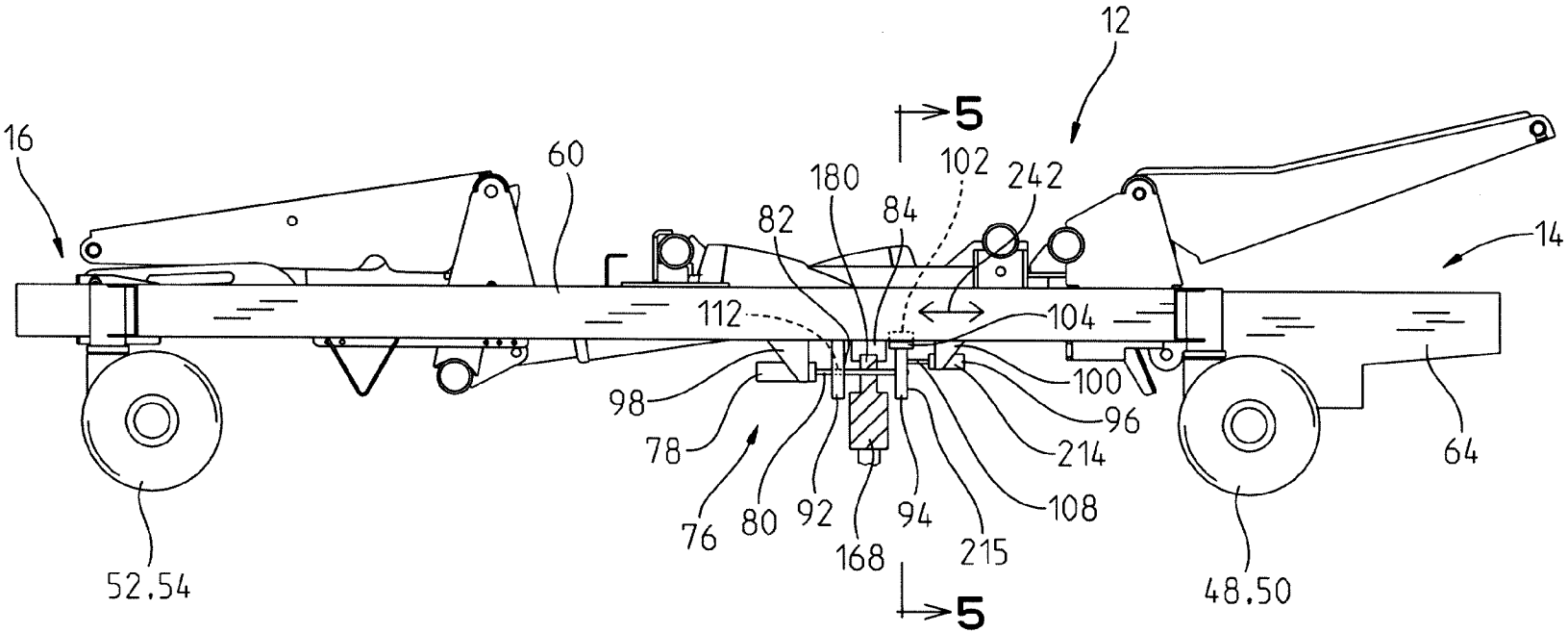
FIG. 4 is a side view of the side-mounted mobile lift docking apparatus of FIG. 3, with a partially sectional view of a leg of a mobile lift docked thereto.
Figure 5:
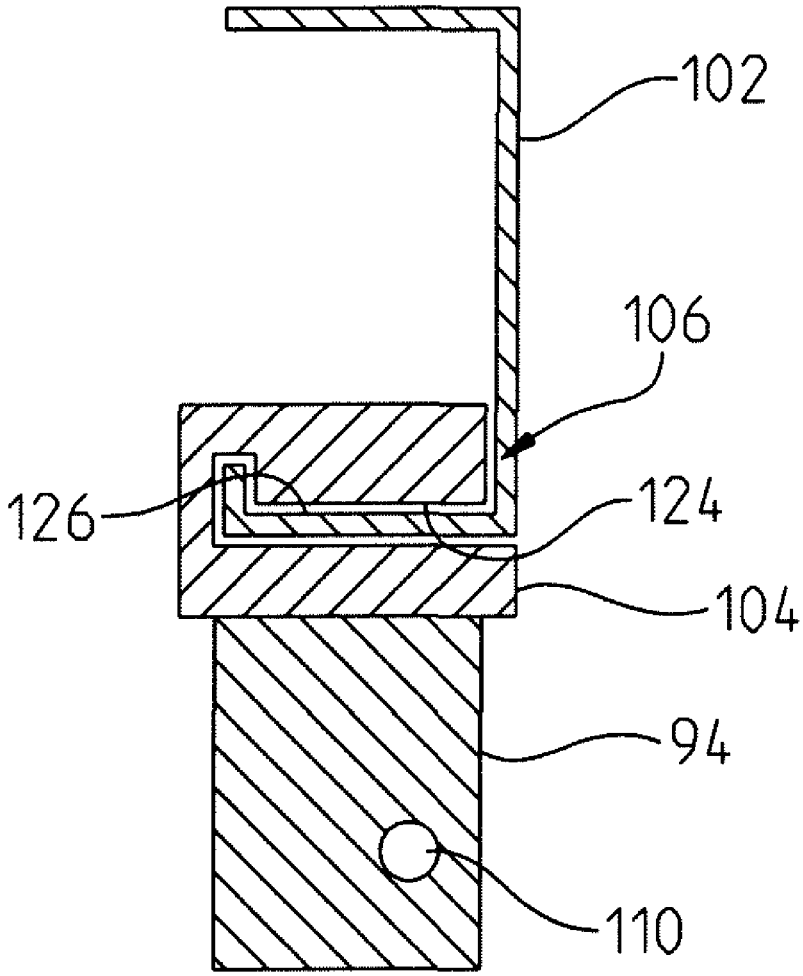
FIG. 5 is a sectional view of a mounting member of the mobile lift docking apparatus of FIGS. 3-4, showing a coupling that slidingly couples the mounting member to the side of the bed.

The docking apparatus 90 is shown in FIGS. 3-5. The docking apparatus 90 is similar to the docking apparatus 56, 58, but it is mountable to a longitudinal side of the base member 60 (i.e., between the head end 14 and the foot end 16). While only one docking apparatus 90 is shown, another more or less identical docking apparatus 90 may be mounted to the same side of the base member 60, spaced from the illustrated docking apparatus, in order for both of the lift legs 166, 168 to be securely docked to the bed 10 rather than only one of them. Also, generally speaking, another docking apparatus 90 (in either the "single leg" or "double leg" configuration) may be mounted to the side of the base member 62, so that the mobile lift 150 may be docked to either side of the bed 10.

The docking apparatus 90 includes one stationary guide member 72, which is configured in a similar fashion as described above, with a bed-to-lift locking mechanism 76 and proximity sensor 82 mounted thereto. The bed-to-lift locking mechanism 76 is mounted to the under side 68 of the base member 60 by a bracket 98.

The other guide member 94 of the docking apparatus 90 is similar in size and shape to the guide member 72, except that the guide member 94 is movable relative to the base member 60 in a longitudinal direction. To provide movement of the guide member 94, an actuator 96 is mounted to the under side 68 of the base member 60 by a bracket 100. One end of a rod 212 of the actuator 96 is coupled to the outer side 214 of the guide member 94. The other end of the rod 212 (opposite the end coupled to the side 214) is coupled to a motor 214. The motor 214 drives the rod 212 in opposing directions, as indicated by the bidirectional arrow 242. Outwardly extension of the rod 212 moves the guide member 94 closer to the guide member 72, and inwardly retraction of the rod 212 moves the guide member 94 further away from the guide member 72. In this way, the space between the guide members 72, 94 may be adjusted to accommodate varying sizes of lift legs 166, 168.

A sliding coupling 106 between the guide member 94 and the base member 60 facilitates the movement of the guide member 94 relative to the base member 60, as shown in FIG. 5. The guide member 94 is mounted to or integral with (e.g. by bolts, welding, or other suitable fastening means) a slidable mounting bracket 104 of the sliding coupling 106. The slidable mounting bracket 104 has a slide 124 formed therein. The slide 124 slidably mates with a track 126, which is defined in a section 102 of the base member. The length of the section 102 is defined by the amount of adjustment potentially required for the docking apparatus 90 to accommodate the anticipated sizes of the lift legs 166, 168. Although not shown, stops may be provided at each end of the section 102 to prevent movement of the guide member 94 beyond the defined range.

The guide member 94 has a hole 110 defined therein, which is similar to the hole 116. Regardless of the position of the guide member 94 relative to the guide member 72, when the guide member 94 is mounted to the base member 60, the hole 110 vertically aligns with the hole 114.

As noted above, the bed 10 has one or more electronically-controllable bed functions or features, which are operated by the BCU 64. Such features may include adjusting the position, length, or width of the bed, raising, lowering, or pivoting a section of the bed, weighing a person positioned on the bed, inflating, deflating, or adjusting inflation in one or more sections of the mattress, laterally rotating a person positioned on the bed, and/or other automated features.

In some embodiments, the electronically-controllable features of the bed 10 may include some features that relate to the docking apparatus 56, 58, 90. As shown in FIG. 6, electrical signal paths 220, 222, 224 connect the locking mechanism 76, the proximity sensor 82, and a voltage supply 240 (which powers the locking mechanism 76). When the proximity sensor 82 detects that a lift leg 166, 168 is in a docking position, electrical output of the proximity sensor 82 closes a switch or otherwise causes electrical input to be delivered to the locking mechanism 76, to cause the locking member 80 to move to the locked position as described above. To undock the lift leg 166, 168, a user activates a lift lock/unlock button 44 as shown in FIG. 7, described below.

In some embodiments of the docking apparatus 90, when the lift leg 166, 168 is in the docking position, the output of the proximity sensor 82 may be communicated to the BCU 64 via a signal path 226. Upon determining that the lift 150 is being docked to the bed 10 (e.g. by executing computerized processes or algorithms using the output of the proximity sensor 82 and/or other information), the BCU 64 may signal the guide actuator 96 to adjust the position of the movable guide member 94, via a signal path 228.

The electronically-controllable features and functions of the bed 10 may be activated, configured, and deactivated by user inputs that are translated into electrical signals and forwarded to the BCU 64 by input devices or input-output devices, which include, in the illustrated embodiment, bed hardpanel controls 36 and a bed user interface 38. The bed hardpanel controls 36 and bed user interface 38 permit certain users, particularly caregivers, to activate and deactivate the electronically-controllable features of the bed 10 (e.g. by applying physical contact thereto). As shown in FIG. 1, the bed user interface 38 may include a graphical depiction of a mobile lift or parts thereof, as well as a number of buttons 40, 42, 44, 46, which control features of the mobile lift 150 when the mobile lift 150 is docked to the bed 10.

The bed hardpanel controls 36 and the bed user interface 38 include circuitry that conveys voltage generated by the controls mounted thereto or displayed thereon (e.g., in the case of a touchscreen user interface) to the BCU 64. In the illustrated embodiment, the bed hardpanel controls 36 and the bed user interface 38 are mounted to the outwardly facing side of at least one of the siderails 30, 32 of the bed 10 (i.e., facing away from the mattress), but the bed hardpanel controls 36 and/or the bed user interface 38 may be placed in any suitable location that is accessible to a caregiver. For example, some caregiver controls may be provided on a wall-mounted device or a remote control device. The illustrated bed user interface 38 is a graphical touchscreen user interface, but this is not required.

Referring to FIG. 7, the buttons 44, 46 are used to control aspects of the docking apparatus 54, 56, 90. The button 44 locks or unlocks the bed-to-lift locking mechanism 76 (e.g. via a toggle). The button 46 is used to adjust the position of the guide member 94 of the docking apparatus 90. Pressing the button 46 causes the guide actuator 96 to move the guide member 94 in one direction. Pressing the button 46 a second time causes the guide actuator 96 to move the guide member 94 in the opposite direction. Output of the proximity sensor 82 may be used to activate or deactivate the guide adjust button 46. For example, the guide adjust button 46 may be disabled (e.g. "grayed out") if the proximity sensor 82 does not detect the presence of a lift leg 166, 168.

The BCU 64 receives the electrical signals from the guide adjust button 46 and the lift lock/unlock button 44 via signal paths 230, 232, respectively. The BCU 64 determines the appropriate action (e.g. by executing computerized processes or algorithms using the signals from the buttons 44, 46 and/or other information). If the BCU 64 determines that the guide actuator 96 is to be actuated, the BCU 64 sends a control signal to the guide actuator 96 via a signal path 234. Similarly, if the BCU 64 determines that the locking mechanism 76 is to be actuated, the BCU 64 sends a control signal to the locking mechanism 76 via a signal path 236.

In some embodiments, the guide adjust button 46 may be used to both adjust the position of the guide member 94 and lock the lift leg 166, 168 to the docking apparatus 90. In these embodiments, the bed-to-lift locking mechanism 76 may be simplified and the lift lock/unlock button 44 may be eliminated.

Generally speaking, both the BCU 64 and the LCU 160 include one or more microprocessors or microcontrollers and electrical and/or computer circuitry mounted on one or more substrates (e.g. printed circuit boards), which are typically located in a housing that is mountable to the bed 10 and the lift 150, respectively.

In the illustrated embodiment, the BCU 64 is mounted to the base 12. However, the BCU 64 may be placed in any suitable location on the bed or elsewhere. The location of the BCU 64 relative to the bed 10 is not important for the purposes of the present disclosure. Similarly, while the LCU 160 is shown as being mounted to the column 154, the location of the LCU 160 relative to the lift 150 is not important for the purposes of the present disclosure.

In many instances, the BCU 64 receives electrical input from a number bed function modules or devices, which include the bed hardpanel controls 36 and the bed user interface 38. The BCU 64, bed-to-lift electrical connector 84, bed hardpanel controls 36, bed user interface 38, locking mechanism 76, guide actuator 96, proximity sensor 82 and signal paths 192, 194, 200, 220, 222, 224, 226, 228, 230, 232, 234, 236 are arranged according to a suitable system architecture (such as a peer-to-peer architecture, a Controller Area Network, or other suitable architecture now existing or developed after the date of this disclosure) to allow unidirectional and/or bidirectional electrical communication among these and other components as required to execute a given feature or function of the bed 10.

The signal paths 192, 194, 196, 198, 200, 220, 222, 224, 226, 228, 230, 232, 234, 236 may include wired or wireless connections, or may be connected to an electronic network, such as an Ethernet network, which may be configured according to a TCP/IP or other suitable electronic communications protocol. In general, each of the representative signal paths 192, 194, 196, 198, 200, 220, 222, 224, 226, 228, 230, 232, 234, 236 may include one or more signal paths therein as may be needed to accomplish the sending and receiving of data and/or instructions between or among the various modules and systems of the bed 10.

Among other things, the BCU 64 processes inputs from the various electronically controlled components and modules of the bed 10, stores data in and retrieves data from memory, and executes computer logic to control the operation of the electronically-controllable features of the bed 10. It is contemplated that the logic, functions and processes identified herein as being part of the BCU 64 may be implemented as one or more distributed modules that are in communication with the BCU 64. Also, the BCU 64 itself may comprise a number of different units or sub-modules rather than being contained in a single housing. For example, the lift control routines (e.g. 140, 142, which enable the BCU 64 to send lift commands to the lift 150) and the bed control routines (e.g. 134, 136, which enable the BCU 64 to receive bed commands from the lift 15) may be designed as separate modules or distributed across multiple storage and/or computing devices connected by a network. The BCU 64 and/or the bed-to-lift electrical connector 84 may include a communications interface that decodes signals received from the lift 150, to allow them to be processed by the BCU 64.

Likewise, the LCU 160 receives electrical input from the controls 188, 190. The LCU 160, controls 188, 190, lift-to-bed electrical connector 184, and signal paths 196, 198 are arranged according to a suitable system architecture to allow unidirectional and/or bidirectional electrical communication as needed for a given function or feature of the lift 150. The signal paths 196, 198 may include wired or wireless connections, or may be connected to an electronic network, such as an Ethernet network, which may be configured according to a TCP/IP or other suitable electronic communications protocol. In general, each of the representative signal paths 196, 198 may include one or more signal paths therein as may be needed to accomplish the sending and receiving of data and/or instructions between or among the electronic components of the lift 150.

Among other things, the LCU 160 processes inputs from the controls 188, 190, stores data in and retrieves data from memory, and executes computer logic to control the operation of the electronically-controllable features of the lift 150. The logic, functions and processes identified herein as being part of the LCU 160 may be implemented as one or more distributed modules that are in communication with the LCU 160. More specifically, the LCU 160 and/or the lift-to-bed electrical connector 184 may include a communications interface that decodes signals from the bed 10 to allow them to be processed by the LCU 160.

Referring to FIG. 9, when the bed-to-lift electrical connector 84 and the lift-to-bed electrical connector 184 are connected, a communication link 200 is created. It is contemplated that the communication link 200 may take the form of a wired or wireless connection. For example, the connectors 84, 184 may each include a wireless transceiver alternatively or in addition to a hard-wired electrical connector, which may operate according to a short range wireless communication protocol (such as the 802.15.4 or Zigbee protocol, or some other suitable wireless protocol, whether now existing or developed after the date of this disclosure).

Depending upon the features and functions of the particular models of the lift 150 and the bed 10 being connected, the communication link 200 may involve one-way communication of signals from the lift 150 to the bed 10, one-way communication of signals from the bed 10 to the lift 150, or two-way communication between the bed 10 and the lift 150.

When the communication link 200 is established, the lift-to-bed electrical connector 184 communicates a signal to the LCU 160 via the signal path 196, to indicate that a bed 10 is electronically connected to the lift 150. Likewise, the bed-to-lift electrical connector 84 communicates a signal to the BCU 64 via the signal path 194, to indicate that a lift 150 is electronically connected to the bed 10.

Upon determining that a bed 10 is connected to the lift 150, the LCU 160 may enable (e.g. "light up") one or more bed control buttons 190, which are mounted to the LCU 160 as shown in FIG. 1, if the buttons 190 were previously disabled (e.g. "grayed out"). The LCU 160 may then receive signals from the bed control buttons 190 via the signal path 198, execute computer logic to formulate the corresponding bed control command using the appropriate command format and/or protocol for the bed model or type of the bed 10 (e.g. by accessing a look-up table or similar data structure stored in memory), and send the bed command to the lift-to-bed electrical connector 184 via the signal path 196.

The bed command issued by the LCU 160 is received by the bed-to-lift electrical connector 84 via the communication link 200 and forwarded to the BCU 64 via the signal path 194. The BCU 64 may, depending upon the configuration of the bed 10, ignore the command or process the command using computer logic to activate the requested bed function or feature. In the illustrated embodiment, the bed control buttons 190 include one or more buttons for raising and lowering the height of the bed frame 20 relative to the base 12, however, other bed control buttons may be provided alternatively or in addition. Thus, when the lift 150 is electronically connected to the bed 10, a caregiver at the lift 150 may raise or lower the bed height as may be needed for a particular patient, without having to walk away from the lift (e.g. to access the siderail-mounted bed controls 36, 38).

Similarly, upon determining that a lift 150 is connected to the bed 10, the BCU 64 may enable (e.g. "light up") one or more lift control buttons 40, 42, which are mounted to the bed user interface 38 as shown in FIG. 1, if the buttons 40, 42 were previously disabled (e.g. "grayed out"). The BCU 64 may then receive signals from the lift control buttons 40, 42 via the signal path or paths 192, execute computer logic to formulate the corresponding lift control command using the appropriate command format and/or protocol for the lift model or type of the lift 150 (e.g. by accessing a look-up table or similar data structure stored in memory), and send the lift command to the bed-to-lift electrical connector 84 via the signal path 194.

The lift command issued by the BCU 64 is received by the lift-to-bed electrical connector 184 via the communication link 200 and forwarded to the LCU 160 via the signal path 196. The LCU 160 may, depending upon the configuration of the lift 150, ignore the command or process the command using computer logic to activate the requested lift function or feature. In the illustrated embodiment, the lift control buttons 40, 42 include one or more buttons for raising and lowering the height of the lift 150 relative to the base 152, and one or more buttons for adjusting the distance between the lift legs 166, 168 (the latter only being possible in embodiments where the lift-to-bed electrical connector 184 is not located on the lift leg 166, 168); however, other lift control buttons may be provided alternatively or in addition. Thus, when the lift 150 is electronically connected to the bed 10, a caregiver at the bed 10 may raise or lower the lift height as may be needed for a particular patient, without having to walk away from the bed (e.g. to access the lift-mounted controls 40, 42).

FIG. 10 illustrates steps or routines of a process that may be implemented using computer circuitry and/or programming, which may be stored in memory and executed by the BCU 64, to enable an electronic communication interface between the bed 10 and the mobile lift 150. While the illustration includes a defined start 130 and end 144, it is contemplated that the process may be initiated and/or concluded at other points, or by other means, depending upon the requirements of a particular implementation.

The routine 132 determines whether a lift 150 is docked to the bed 10, either by processing output of the proximity sensor 82, by determining that the communication link 200 has been successfully established, or by other means. If a lift 150 is not docked to the bed 10, then the process terminates, or suspends until a lift 150 is detected as being docked to the bed 10. If a lift 150 is docked to the bed 10, the routine 134 is invoked.

The routine 134 determines whether the bed 10 has received any communications from the lift 150, by determining whether the bed-to-lift electrical connector 84 has sent a bed command to the BCU 64 via the signal path 194, or by other means. If the BCU 64 has received a bed command from the lift 150, the routine 136 processes and executes the bed command as described above. After the bed command is executed, or if no bed command has been received from the lift 150; or prior to or while the routine 134 is executing, the routine 138 enables the lift controls 40, 42 if they were previously disabled. Once the lift controls 40, 42 are enabled, the routine 140 monitors the inputs to the BCU 64 to determine whether a user has activated (e.g. touched or depressed) one of the lift controls 40, 42. If a lift control 40, 42 has not been activated, the process returns to the routine 132. If a lift control 40, 42 has been activated, the routine 142 formulates the appropriate lift command and sends it to the bed-to-lift electrical connector 84, for transmission to the lift 150 via the communication link 200.

There are many advantages of the present disclosure arising from the various features described herein. It will be noted that alternative embodiments of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A patient support, comprising:

a base supported by a plurality of wheels and having a downwardly facing under side and an upwardly facing top side opposite the under side, a frame supported above the base, the frame having a head end and a food end spaced from the head end, a deck supported by the frame, the deck being configured to support a person in a plurality of positions including a laying-down position and a sitting position, and a docking apparatus comprising a guide mounted to the under side of the base and configured to guide a leg of a mobile lift to a docking position underneath the base in which the leg may be secured relative to the patient support, the docking apparatus being spaced from the head end of the frame, coupled to the base, located substantially beneath the top side of the base, and configured to engage at least one leg of the mobile lift, the mobile lift including a lift arm configured to assist a person in moving from one location to another, the at least one leg of the mobile lift being supported by a wheel, and the docking apparatus being configured to secure the position of the mobile lift relative to the patient support while a person is being transferred from the patient support to the mobile lift or from the mobile lift to the patient support.

2. The patient support of claim 1, wherein the guide comprises a pair of guide members, the guide members are spaced apart by a distance, and the distance is configured to receive the leg of the mobile lift therein.

3. The patient support of claim 2, comprising an actuator coupled to the guide to adjust the distance between the guide members.

4. The patient support of claim 2, comprising a second guide coupled to the base and spaced from the first guide, wherein the second guide comprises a pair of guide members configured to guide a second leg of the mobile lift to a docking position underneath the base.

5. The patient support of claim 4, wherein the guide members extend downwardly from the under side of the base.

6. The patient support of claim 1, wherein the docking apparatus comprises an electrical connector configured to mate with an electrical connector of the mobile lift to establish an electrical communication link between the patient support and the mobile lift.

7. The patient support of claim 1, wherein the docking apparatus comprises a sensor, wherein the sensor is configured to detect the presence of a leg of a mobile lift in the docking position.

8. The patient support of claim 1, wherein the docking apparatus is mounted to the base adjacent the foot end of the frame and configured to engage a portion of a leg of the mobile lift when the mobile lift is positioned adjacent the foot end of the frame.

9. The patient support of claim 1, wherein the docking apparatus is mounted to the base between the head end and the foot end of the frame and configured to engage a portion of a leg of the mobile lift when the leg of the mobile lift is positioned between the head end and the foot end of the frame.

10. The patient support of claim 1, wherein the docking apparatus is configured to engage a portion of the leg of the mobile lift when the portion of the leg is positioned underneath the base.

11. A lift-to-bed docking apparatus, comprising a lift guide comprising a top surface couplable to an under side of a support member of a bed and at least one downwardly extending surface configured to guide a leg of a mobile lift to a docking position underneath the bed, a bed-to-lift connector coupled to the lift guide, and a lift-to-bed connector couplable to a mobile lift, the mobile lift having a lift arm configured to assist a person in moving from one location to another, the lift-to-bed connector being configured to connect with the bed-to-lift connector to secure the mobile lift in the docking position while a person is being transferred from the bed to the mobile lift or from the mobile lift to the bed.

12. The lift-to-bed docking apparatus of claim 11, wherein the lift guide comprises at least one downwardly extending guide member.

13. The lift-to-bed docking apparatus of claim 11, wherein one of the bed-to-lift connector and the lift-to-bed connector comprises a retaining mechanism configured to releasably connect the leg of the mobile lift with the bed.

14. The lift-to-bed docking apparatus of claim 13, wherein each of the bed-to-lift connector and the lift-to-bed connector comprises an electrical connector configured to mate with the other to establish an electrical communication link between the patient support and the mobile lift.

15. The lift-to-bed docking apparatus of claim 11, wherein one of the bed-to-lift connector and the lift-to-bed connector comprises a sensor configured to detect a position of the leg relative to the bed.

16. A control system for a bed, configured to:

determine whether a mobile lift is connected to the bed, the mobile lift including a lift arm configured to assist a person in moving from one location to another, receive input from a user control of the bed, the user control being configured to control a feature of the mobile lift, if the mobile lift is connected to the bed, and communicate with the mobile lift to cause the feature of the mobile lift to be controlled in accordance with the user control of the bed.

17. The control system of claim 16, configured to receive a signal from the mobile lift, the signal being configured to control a feature of the bed, and to cause the feature of the bed to be controlled by the signal from the mobile lift.

18. The control system of claim 17, wherein the signal is configured to control the raising and lowering of a portion of the bed.

19. The control system of claim 16, wherein the user control of the bed is configured to control the raising and lowering of the lift arm of the mobile lift.

* * * * *